United States Patent [19]

Campodonico

[11] Patent Number: 4,590,708

[45] Date of Patent: May 27, 1986

[54] ARRANGEMENT FOR TILTABLY MOUNTING A WINDOW SASH

[75] Inventor: Salvatore I. Campodonico, Blauvelt, N.Y.

[73] Assignee: Allen-Stevens Corp., Woodside, N.Y.

[21] Appl. No.: 707,242

[22] Filed: Mar. 1, 1985

[51] Int. Cl.[4] ..... E05D 15/22

[52] U.S. Cl. ..... 49/181

[58] Field of Search ..... 49/181, 446, 453

[56] References Cited

U.S. PATENT DOCUMENTS

| | | | |
|---|---|---|---|
| 3,434,236 | 3/1969 | Weidner et al. | 49/181 X |
| 3,482,354 | 12/1969 | Trout | 49/181 |
| 3,789,549 | 2/1974 | Yip | 49/181 |
| 3,797,168 | 3/1974 | Trout | 49/181 |
| 3,844,066 | 10/1974 | Nobes | 49/181 |
| 3,959,926 | 6/1976 | Noecker et al. | 49/181 |
| 4,068,406 | 1/1978 | Wood | 49/181 |
| 4,144,674 | 3/1979 | Dovman | 49/181 X |
| 4,227,345 | 10/1980 | Durham, Jr. | 49/181 |
| 4,363,190 | 12/1982 | Anderson | 49/181 |
| 4,364,199 | 12/1982 | Johnson et al. | 49/181 |

*Primary Examiner*—Philip C. Kannan

*Attorney, Agent, or Firm*—Kirchstein, Kirschstein, Ottinger & Israel

[57] ABSTRACT

An arrangement for tiltably mounting a lateral portion of a window sash in a track of a window frame for sliding longitudinally of the track and for tilting out of the plane of the window frame includes a mounting slide received in the track and including a main portion having an opening that receives a mounting region of a shank portion of a bearing element. The main portion further has two arms which depend from a top region of the main portion and have holding regions which embrace a spreading region of the bearing element. The spreading region includes two flats in an otherwise cylindrical outline, these flats facing the holding regions while the window sash is in the plane of the window frame such that retaining regions of the arms are spaced from side portions of the track and the mounting slide is free to move along the latter. When the window sash is tilted, the cylindrical outline of the spreading region presses the arms and thus the detaining regions toward and against the side portions of the track, thus arresting the mounting slide in position. The detaining regions are separated from the holding regions by respective slots which permit limited relative elastic displacement therebetween.

9 Claims, 8 Drawing Figures

FIG. 1
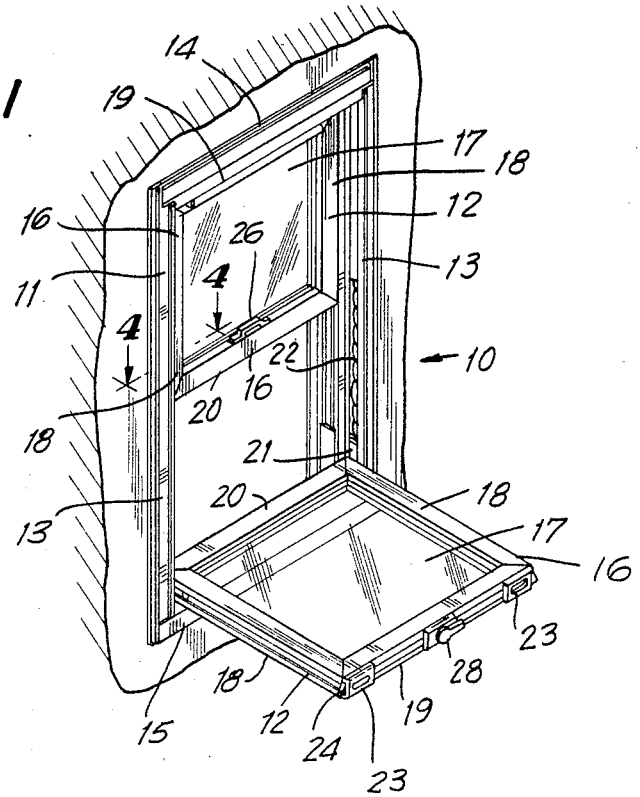
FIG. 3
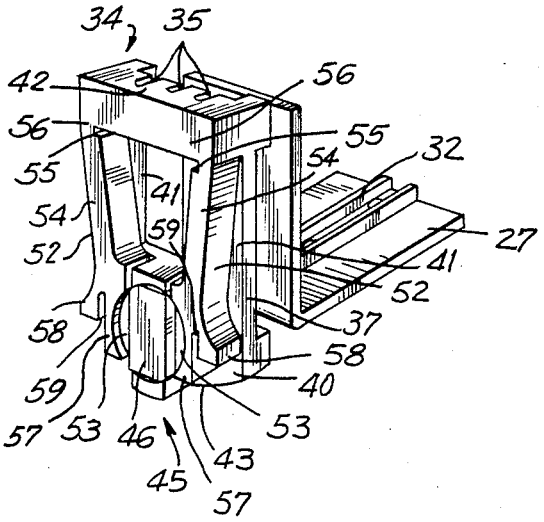
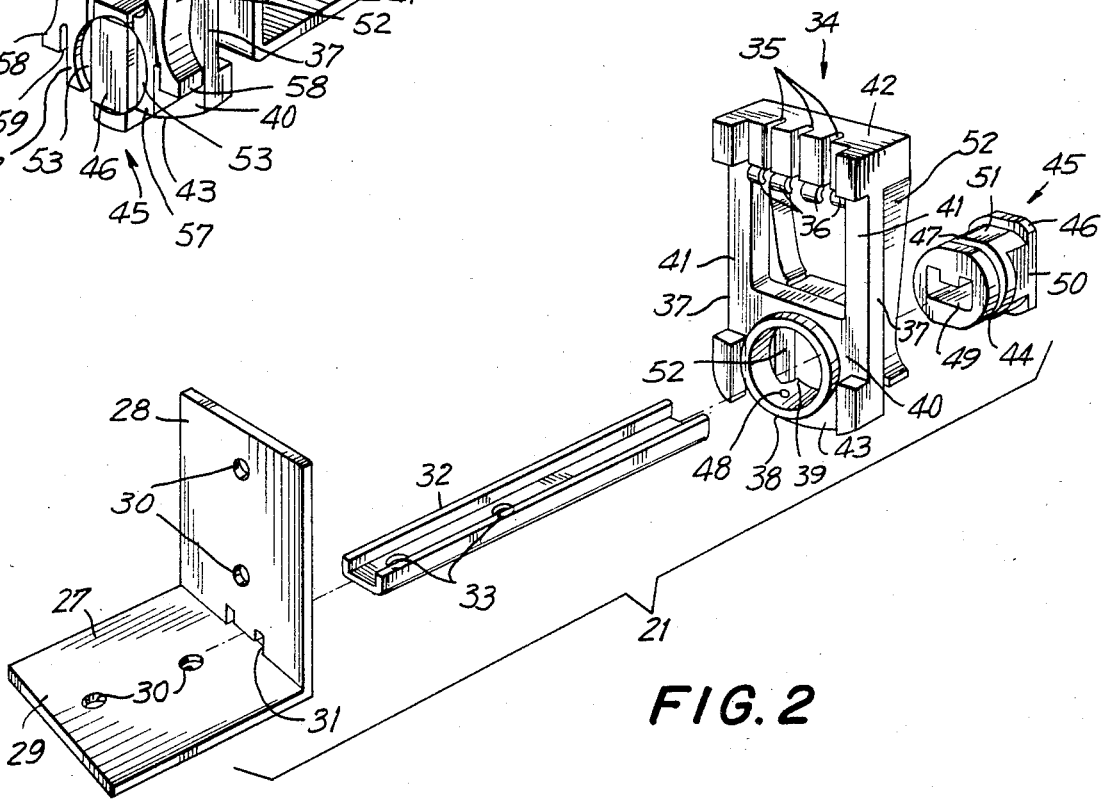
FIG. 2

ARRANGEMENT FOR TILTABLY MOUNTING A WINDOW SASH

BACKGROUND OF THE INVENTION

The present invention relates to sash windows in general, and more particularly to an arrangement for tiltably mounting a lateral region of a window sash in a track provided in a lateral portion of a window frame for sliding movement in the longitudinal directions of the track, and for tilting out of the plane of the window frame.

There are already known various arrangements of the type here under consideration. Examples of such arrangements can be found in U.S. Pat. Nos. 3,434,236; 3,482,354; 3,789,549; 3,797,168; 3,844,066; 4,068,406; 4,227,345; 4,363,190; and 4,364,199. Window sashes equipped with such arrangements differ from the traditional window sashes which are merely slidable up and down in respective tracks of the lateral portions of the window frames in that they can also be tilted out of the plane of the window frame when so desired, for instance, for cleaning purposes. Of course, it is necessary to arrest the sliding movement of the window sash when the same is in its tilted position, in order to prevent unwanted sliding of the sash window while it is in its tilted position. Most if not all of the above references disclose arrangements which achieve automatic arresting of the region about which the tilting is taking place in the respective track in response to the commencement of the tilting movement. However, experience with the known mounting arrangements of this type has shown that they leave much to be desired in terms of reliability, simplicity of construction, and ease of operation.

SUMMARY OF THE INVENTION

Accordingly, it is a general object of the present invention to avoid the disadvantages of the prior art.

More particularly, it is an object of the present invention to provide a tiltably mounting arrangement for window sashes, which does not possess the disadvantages of the conventional arrangements of this type.

Still another object of the present invention is so to construct the arrangement of the type here under consideration as to assure that the window sash will be arrested in its tracks during its displacement into and stay in its tilted position, even if the dimensions of the track deviate considerably from the nominal dimensions.

It is yet another object of the present invention so to design the arrangement of the above type as to be particularly suited for use in conjunction with vinyl window frames and sash frames.

A concomitant object of the present invention is to devise an arrangement of the above type which is simple in construction, inexpensive to manufacture, easy to install and use, and reliable in operation nevertheless.

In pursuance of these objects and others which will become apparent hereafter, one feature of the present invention resides in an arrangement for mounting a lateral region of a window sash in a track of a lateral portion of a window frame for sliding longitudinally of the track in a normal position of the window sash in which the latter extends along the plane of the window frame, and for tilting into a plurality of a tilted positions in which the window sash includes different angles with the plane of the window frame, this mounting arrangement comprising a mounting slide received in the track for sliding longitudinally thereof and including a main portion having two lateral portions each having a sliding surface facing oppositely with respect to the respectively other sliding surface and away from the latter and toward a respective side portion of the track for slidingly guiding the main portion in the track, and top and bottom portions, means for bounding a cylindrical through opening through the main portion, and two arms depending from the top portion in juxtaposition with the main portion to and beyond the opening, these arms having respective holding regions which bound a passage therebetween which is axially aligned with the opening and detaining portions which face the side portions of the track, the arms being resiliently yieldable substantially in opposit directions along the bottom portion of the main portion toward and away from the respective side portions of the track while being integral with the top portion of the mounting slide. The arrangement of the present invention further includes a bearing element having a substantially cylindrical shank portion and a disc-shaped end flange portion delimiting the shank portion, the shank portion having a mounting region which, in an assembled condition of the bearing element with the mounting slide, is received in the opening of the main portion of the latter, and a spreading region situated intermediate the mounting region and the end flange portion and passing through the passage in the assembled condition, the spreading region having at least two diametrically opposite first surfaces spaced a smaller first distance from one another, and at least two diametrically opposite second surfaces spaced a greater second distance from one another and situated circumferentially between the first surfaces, the first and second surfaces facing the holding regions of the arms respectively in a first and a second position of the bearing element to determine the spacing of the arms from one another. Finally, the arrangement comprises means for mounting the bearing element on the lateral region of the window sash for joint tilting movement therewith, with the normal position corresponding to the first position with the detaining portions of the arms being spaced from the side portions of the track for permitting unimpeded movement of the mounting slide longitudinally of the track, and with the tilted position corresponding to the second position with the second surfaces pressing the detaining portions against the side portions of the track for detaining the mounting slide in its then assumed position in the track so long as the sash window is in its tilted position.

A particular advantage of the construction as described so far is that it is very simple, in that the two arms are integral with or of one piece with the main portion of the mounting slide, and depend on the inherent resiliency of the material of the mounting slide for conformingly spreading apart and returning in response to the turning of the bearing element. Yet, the detaining portions securely engage the side portions of the track and thus detain the mounting slide in the then assumed position thereof.

According to a further aspect of the present invention, the mounting means for the bearing element includes an elongated support element which is connected to the lateral region of the window sash and has a non-circular cross section, the support element extending into the bearing element and being connected thereto for joint movement. Advantageously, the support element has a substantially U-shaped cross section. In this respect, it is particularly advantageous when the bearing element has a recess extending over at least a part of the axial dimension of the bearing element and having a U-shaped cross section substantially conforming to that of the support element for receiving a free end portion of the latter.

According to another facet of the present invention, each of the arms has a slot separating the detaining portion from the holding region for permitting limited elastic displacement of the former with respect to the latter. It is also advantageous when the mounting region of the shank portion of the bearing element has a circumferentially extending groove therein, and the main portion of the mounting slide has at least one bulge in the opening, this bulge being received in the aforementioned groove. This expedient assures that the bearing element will not be unduly displaced axially of the opening in the main portion of the mounting slide.

An especially simple and otherwise advantageous construction of the arrangement of the present invention is obtained when the first surfaces are respective flats in the spreading region, and the second surfaces are partially cylindrical surfaces extending between the flats. In this respect, it is particularly advantageous when the mounting region of the stem portion of the bearing element is substantially cylindrical, when the second surfaces are substantial extensions of the outline of the mounting region onto the spreading region while the first surfaces are inwardly recessed therefrom, and when the holding regions extend into close proximity of the first surfaces in the first position of the bearing element to engage behind the mounting region. An advantageous further development is for the holding regions of the arms to have a recess therein for substantially conformingly and fully receiving the flange portion of the bearing element and for permitting such flange portion to turn in the recess during the turning motion of the bearing element relative to the mounting slide.

The novel features which are considered as characteristic of the invention are set forth in particular in the appended claims. The improved tiltably mounting arrangement for sash windows, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a perspective view of a sash window with at least one of the sashes being tiltably mounted on the window frame by a mounting according to the invention;

FIG. 2 is an exploded view of a mounting device according to the invention which constitutes a part of the mounting arrangement;

FIG. 3 is a perspective view of the mounting device of FIG. 2 in its assembled condition as viewed from the opposite direction;

DETAILED DESCRIPTION OF THE PREFERRED EMBODIMENT

Figure 4:
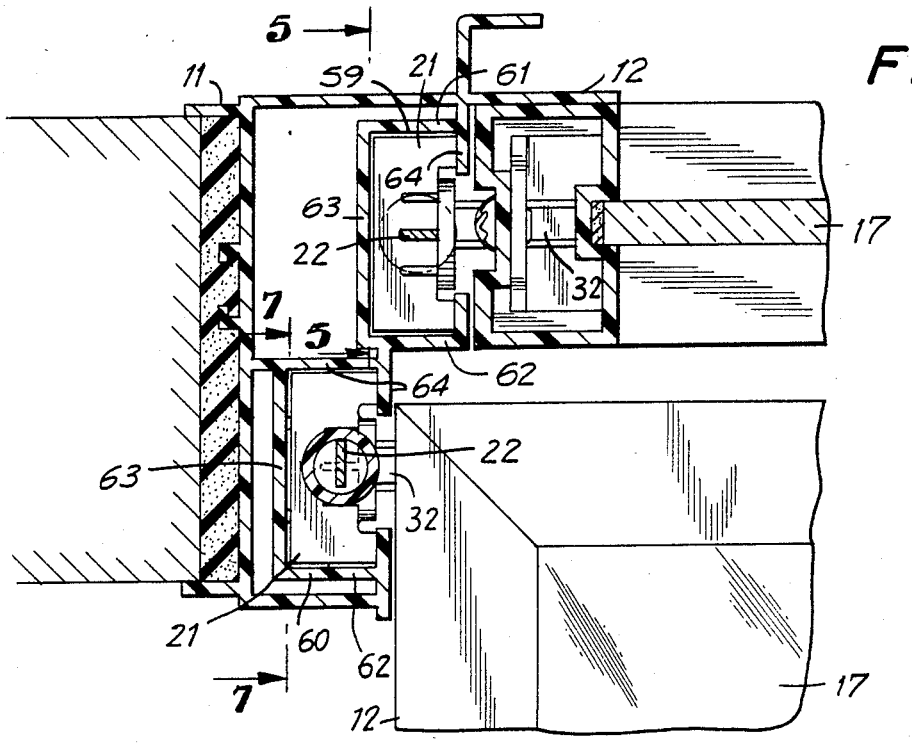
FIG. 4 is a fragmentary cross-sectional view taken on line 4—4 of FIG. 1.

Referring now to the drawing in detail, and first to FIG. 1 thereof, it may be seen that the reference numeral 10 has been used therein to identify a sash window in its entirety. The sash window 10 includes as its main components a window frame 11 and two window sashes 12. The window frame 11 includes two lateral portions 13, a top portion 14 and a bottom portion 15. Each of the window sashes 12 includes a sash frame 16 which has at least one window pane 17 mounted therein and includes two lateral frame portions 18, a top frame portion 19, and a bottom frame portion 20. The window frame 11 and the sashes 12 are, at least in those respects which are important for the understanding of the present invention, mirror-symmetrical about a vertical central plane, and are equipped with various accessories yet to be described which are also arranged mirror-symmetrically with respect to the vertical central plane, so that the same reference numerals will be used herein for identifying such portions of the window frame 11 and of the sashes 12, and such accessories, which correspond to one another at the respective sides of the window 10, and it will be understood that the description of the construction of the window 10 at one of its sides is equally applicable to the construction of the other side of the window 10, with the operation being also indentical.

At least one, but preferably each, of the window sashes 12 is mounted on the window frame 11 for sliding movement in the vertical directions by means of two mirror-symmetrically arranged mounting accessories or devices 21, of which only one is partially visible in FIG. 1. The respective mounting device 21 may be suspended on a chain or any other elongated flexible element 22 which is constructed and used in a conventional manner to carry and/or compensate for at least a part of the weight of the respective window sash 12. The mounting devices 21 are mounted on the respective sash frame 12 at the corner regions at which the bottom sash frame portion 20 meets the respective lateral sash frame portions 18. The mounting devices 21 also permit the respective window sash 12 to tilt about a horizontal axis, as shown in FIG. 1 for the lower window sash 12. At the regions of merger of the upper sash frame portion 19 with the lateral sash frame portions 18, the sash frame 12 has two symmetrically arranged guiding devices 23 of a known construction mounted thereon. The guiding devices 23 are of a construction akin to that of a latching device, that is, each of them includes a latching element 24 which is resiliently mounted and which engages in a corresponding channel (not shown in FIG. 1) of the respective lateral window frame portion 13 to guide the upper part of the respective window sash 12 in the window frame 11 until purposely disengaged or released to permit the tilting of the respective window sash 12 toward its substantially horizontal position. The upper sash frame portion 19 of the inner window sash 12 carries another accessory, that is, a conventional window lock hook device 25, while the lower sash frame portion 20 of the outer window sash 12 has mounted thereon another accessory, that is, a conventional window lock catch 26 which is engaged by the window lock hook device 25 when both window sashes 12 are in their vertical positions and when the outer window sash 12 is all the way up, and the inner window sash all the way down, in order to lock the window sashes 12 in place. All this is well known to those familiar with the construction of sash windows, so that it is not necessary to discuss the general principles of sash window construction and operation here in any more detail than already done. Rather, the following discussion will concentrate on the construction and operation of the mounting device 21 which, in accordance with the present invention, is constructed in a novel way.

As shown in FIG. 2, the mounting device 21 includes a bracket 27 of an angular configuration which has two mutually substantially perpendicularly extending arms 28 and 29 which are provided with respective openings 30 for the passage of screws or similar fasteners by means of which the bracket 27 is connected to the respective lateral and bottom sash frame portions 18 and 20 such that the bracket 27 hugs or embraces the respective window sash corner. The arm 28 of the bracket 27 is provided with a substantially U-shaped centrally arranged aperture 31 for receiving a correspondingly U-shaped elongated support element 32. The support element 32 has openings 33 which are alingned with the openings 30 of the arm 29 of the bracket 27 in the assembled condition of the mounting device 21 to permit the passage of the aforementioned fastening elements therethrough, and thus to assure that the elongated support element 31 will be held in a stationary position with respect to the respective corner region of the respective window sash 12.

One of the main components of the mounting device 21 is a mounting element or slide 34. The slide 34 is provided, at its upper region facing the bracket 27, in a conventional manner with open channels 35 and with substantially hook-shaped retaining members 36 which are arranged downwardly below and between and in flanking relationship with the open slots or channels 35. The slots 35 and the retaining members 36 serve in a known manner for the attachment of the mounting slide 34 to and its suspension from the aforementioned elongated flexible element 22. The slide 34 has two oppositely facing sliding surfaces 37 which, in the operative condition of the mounting device 21 shown in FIG. 1, contact and slide in the respective lateral window frame portion 13, in a manner that will be discussed in a greater detail later. The mounting slide 34 further includes, at its major surface facing toward the bracket 27, an annular projection 38 which is shown to be integral with the remainder of the slide 34. The annular projection 38 bounds one end of an opening 39 which continues all the way through the remainder of a main portion 40 of the mounting slide 34. The main portion 40 is of a substantially rigid frame-shaped configuration, is provided on its two opposite lateral portions 41 with the sliding surfaces 37, and carries on its upper connecting portion 42 the slots 35 and and the hook-shaped retaining members 36, while the annular projection 38 and the opening 39 are provided respectively on and in a bottom portion 43 of the main portion 40.

The opening 39 is dimensioned to receive at least a part of a shank portion 44 of a bearing element 45. The shank portion 44 is basically cylindrical, except as noted below, and is adjoined at one of its axial ends by an end flange 46. The shank portion 44 is shown to be provided with a circumferentially extending groove 47, while the surface bounding the opening 39 is shown to be provided with at least one bulge 48 which is received in the groove 47 when the shank portion 44 is received in the proper desired position in the opening 39. However, in many cases the groove 47 and the bulge 48 can be omitted, so long as it is assured in a different manner that the shank portion 44 will not unduly move in the axial direction of the opening 39. One such possibility will be discussed later. The shank portion 44 further includes a central recess 49 which has a cross-sectional configuration substantially corresponding to that of the elongated support element 32 for substantially conformingly receiving a free end portion of the latter for joint movement therewith relative to the mounting slide 34. The bearing element 45 is provided at its outer circumference with two substantially oppositely facing flats 50 which extend in the axial direction over the flange 46 and over a part of the shank portion 44. The remainder of the shank portion 44, which is prefereably co-extensive with that part of the shank portion 44 which is received in the opening 39, has a substantially cylindrical outline. The shank portion 44 is further shown to have two additional flats 51 arranged in the circumferential direction intermediate the flats 50 but being provided only on the shank portion 44 and not on the flange 46. These additional flats 51, however, are not crucial for the present invention and can be omitted if so desired. The bearing element 45 is shown in FIG. 2 in its position relative to the mounting slide 34 in which the mounting device 21 is freely slidable in the respective lateral window frame portion 13.

FIG. 3 shows the mounting device 21 in its assembled condition, with the bearing element 45 in the same position with respect to the mounting slide 34 as before. This position will be referred to as the releasing position. It may be seen that the top portion 42 of the mounting slide 34 extends in one axial direction beyond the frame-shaped main portion 40 and that it carries two oppositely arranged depending arms 52. The main portion 40 is made of a material which is relatively rigid and yet elastically yieldable, especially of a synthetic plastic material such as Delrin which has a modulus of elasticity of 450,000 psi and flows at O.2 inches per minute during ASTM test D-638. The arms 52 are integral with the top portion 42, but are separated from the lateral portions 41, so that they can elastically yield about the regions of merger thereof with the top portion 42 and can additionally bend along their length. This means, more particularly, that the arms 52 can be spread apart by the action of the shank portion 44 of the bearing element 45 as the latter is rotated about its axis by the action of the elongated support element 32 thereon. In this respect, it is to be mentioned that in the position of the bearing element 45 as illustrated in FIG. 3 the flats 50 are juxtaposed with and possibly abut the respective arms 52, so that the arms 52 are at their closest distance from one another as permitted by the bearing element 45 in the assembled condition, and that a rotation of the bearing element 45 in either circumferential direction will bring the cylindrical portion of the shank portion 44 into juxtaposition and contact with the respective arms 52, thus causing such arms 52 to move away from one another. Returning now to FIG. 2 of the drawing, it may be seen that the arms 52 in their closest position to one another are closer to each other at the region of the opening 39 than the diameter of the latter in the absence of the shank portion 44 from the opening 39. This, of course, means that the circular or cylindrical remainder of the shank portion 44 which adjoins the portion with the two flats 50 engages behind the arms 52 once the shank portion 44 is fully inserted into the opening 39. This engagement by itself may be sufficient for securely holding the bearing member 45 against axial displacement, so that the groove 47 and the bulge 48 can be dispensed with, if so desired. FIG. 3 also shows that the arms 52 have respective part-circular recesses 53 at their surfaces facing away from the main portion 40 for receiving the flange 46 of the bearing element 45 and for letting the flange 46 freely turn therein as the bearing element 45 is being turned about its axis. Preferably, the depth of the recesses 53 substantially corresponds to the axial dimension of the flange 46, so that the end face of the flange 46 is substantially flush with the end faces of the arms 52 in the assembled condition of the mounting device 21.

As also shown in FIG. 3, each of the arms 52 has a lever portion 54 which is undercut by a slit 55 to form a hinge portion 56 at its region of merger with the top portion 42. Each lever portion 54 is provided at its free end remote from the hinge portion 56 with a holding region 57 which embraces the part of the shank portion 44 of the bearing element 45 which is provided with the flats 50, and with a detaining portion 58 which, in the condition shown in FIG. 3, is substantially flush with or slightly inwardly spaced from the respective lateral portion 41 of the main portion 40 or the sliding surface 37 thereof, while the aforementioned spreading of the arms 52 or of the lever portions 54 thereof will cause the detaining portions 58 to project beyond the respective sliding surfaces 37. The reason for this action will become apparent as the description proceeds. At this juncture, it is to be mentioned that the detaining portion 58 are separated from the respective holding regions 57 by respective slots 59 which permit the respective detaining portion 58 to elastically yield relative to the holding region 57 to the extent necessary for compensating for irregularities.

Having so described the construction of the mounting device 21, its operation will now be discussed in conjunction with FIGS. 4 to 7 as it is being used in a window frame 11 made of vinyl, with the window sash frames 16 being also made of vinyl. However, it will be appreciated that the mounting device 21 may be used with the window frame 11 and sash frames 16 being made of different materials, such as wood or aluminum, as well. The window frame 11 and the sash frames 16, as well as the elongated flexible elements 22 are of well-known constructions and configurations, so that they will be discussed here only to the extent necessary for understanding the present invention.

The window frame 11 includes, as already mentioned before, two lateral window frame portions 13. Each of the lateral window frame portions 13 bounds two channels 59 and 60 each of which accommodates one of the mounting devices 21. The channel 59 is shown to be bounded by two opposite side portions 61 and 62, a bottom portion 63, and a slotted top portion 64, while the channel 60 is shown to be bounded by corresponding side portions 61 and 62, a bottom portion 63 and a top portion 64. Here again, the same reference numerals are being used to identify corresponding parts, in order to simplify the description and facilitate the understanding of the present invention. The elongated support elements 32 extend through the slotted top portions 64, as evident in FIG. 4, while the mounting element 21 is received in its entirety in the interior of the respective channel 59 or 60, for sliding movement therein in the normal position of the respective sash 12 as shown in FIGS. 1 and for for the upper sash 12. The reason for this freedom of movement of the mounting device 21 longitudinally of the channel 59 or 60 will become apparent from consideration of FIG. 5. It is shown there that the bearing element 45 is in its releasing position in which the arms 52 are the closest to one another. This means that the resiliency of the material of the arms 52 urges the holding regions 57 toward or against the aforementioned flats 50, so that the detaining portions or regions 58 are spaced from the respective side portions 61 and 62. This permites the sliding surfaces 37 of the main portion 40 to slide along the side portions 61 and 62. While substantial gaps have been shown between the side portions 61 and 62 and the sliding surfaces 37, in reality the sizes of such gaps will be much smaller or no such gaps will exist, so as to keep the danger of canting of the main portion 40 in the channel 59 or 60 to a minimum. Typically, the width of the tracks or channels 59 and 60 as considered between the side portions 61 and 62 is 1.282" nominal, and can be 1.262" on the low side, and 1.302" on the high side. Of course, the width of the respective track 59 or 60 will determine the size of such gaps.

Figure 6:
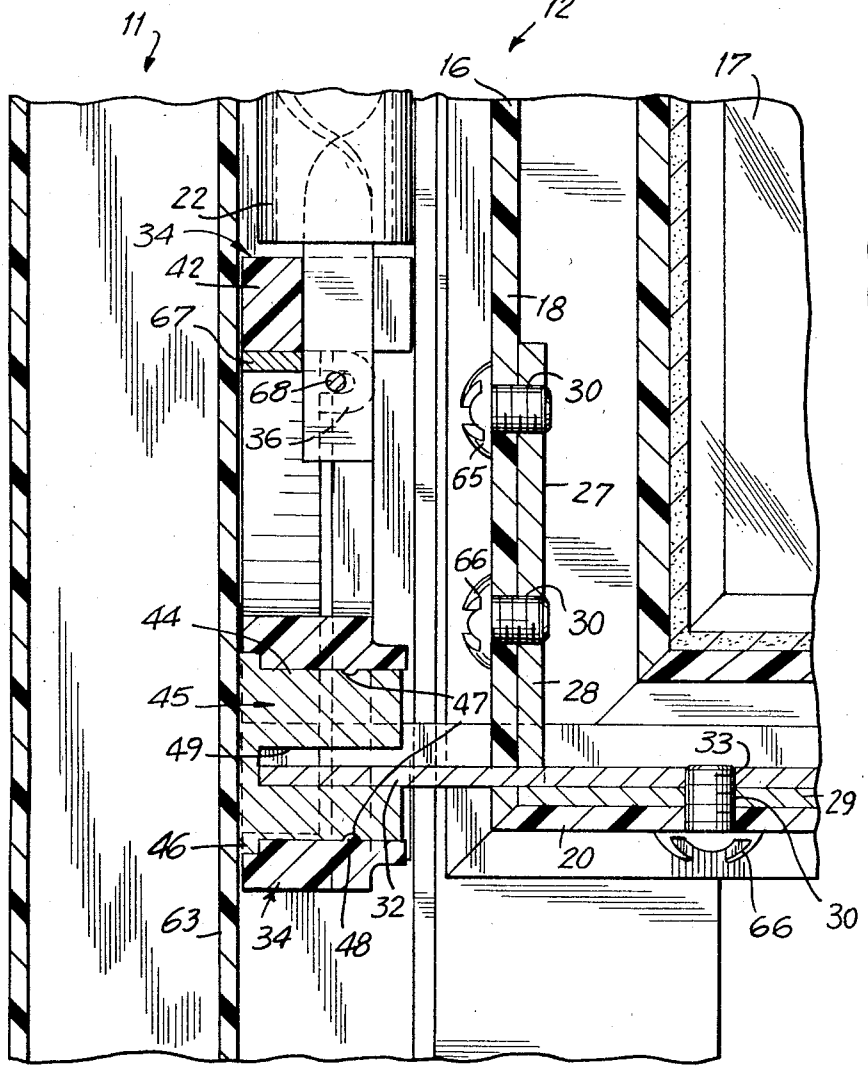
FIG. 6 is another fragmentary cross-sectional view taken on line 6—6 of FIG. 5.

FIG. 6 shows some additional details, especially with respect to the mounting of the mounting device 21 on the sash frame 16. It may be seen there that the bracket 27 is accommodated within the sash frame 16 and is connected to the respective lateral and bottom portions 18 and 20 by means of respective screws 65 and 66. The screws 65 are threaded into the openings 30 of the arm 28 of the bracket 27, while the screws 66 (only one being shown in FIG. 6) extend through the openings 30 of the arm 29 of the bracket 27 and are threaded into the openings 33 of the elongated support element 32. FIG. 6 also shows that the elongated support element 32 extends into the recess 49 of the bearing element 45 and that the recess 49 terminates approximately at the region of the flange 46, that is, that it does not extend all the way through the bearing element 45. It is also shown there that more than one bulge 48 may be provided and be received in the groove 47. The hook-shaped portions 36 are shown to be provided on an element, preferably a metallic element 67 separate from the top portion 42 and rigidly connected thereto, and to engage a pin-shaped connecting element forming a part of the elongated flexible element 22.

Figure 5:
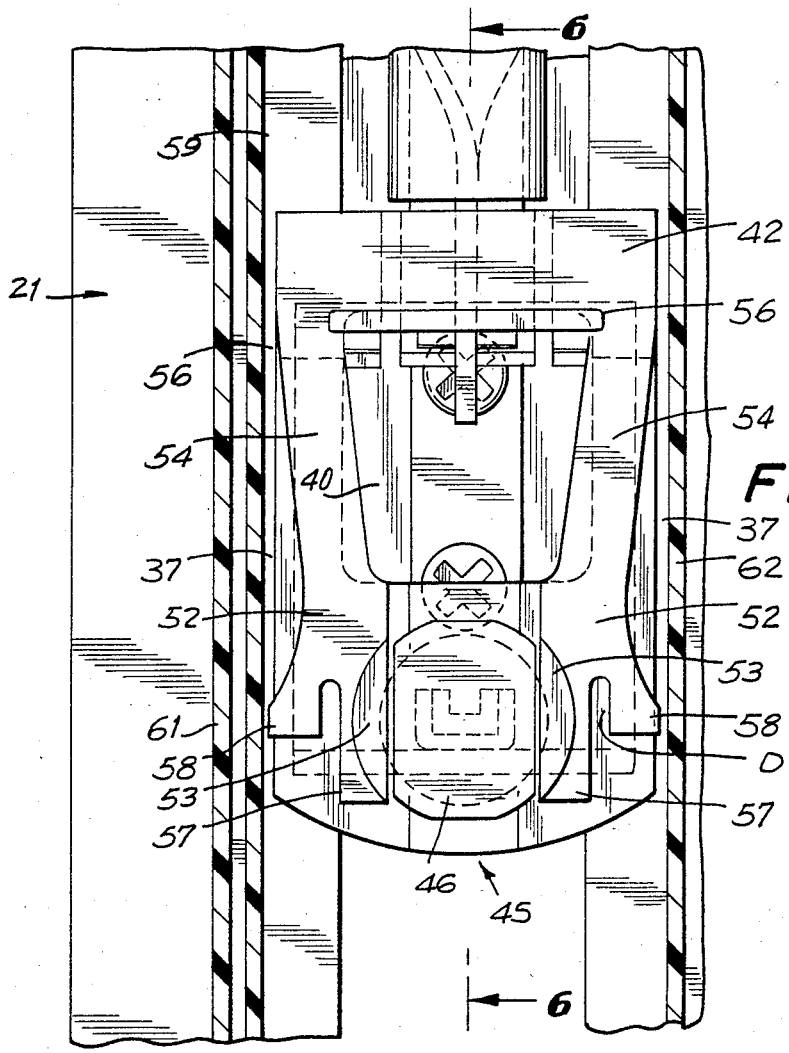
FIG. 5 is a fragmentary enlarged cross-sectional view taken on line 5—5 of FIG. 4.
Figure 7:
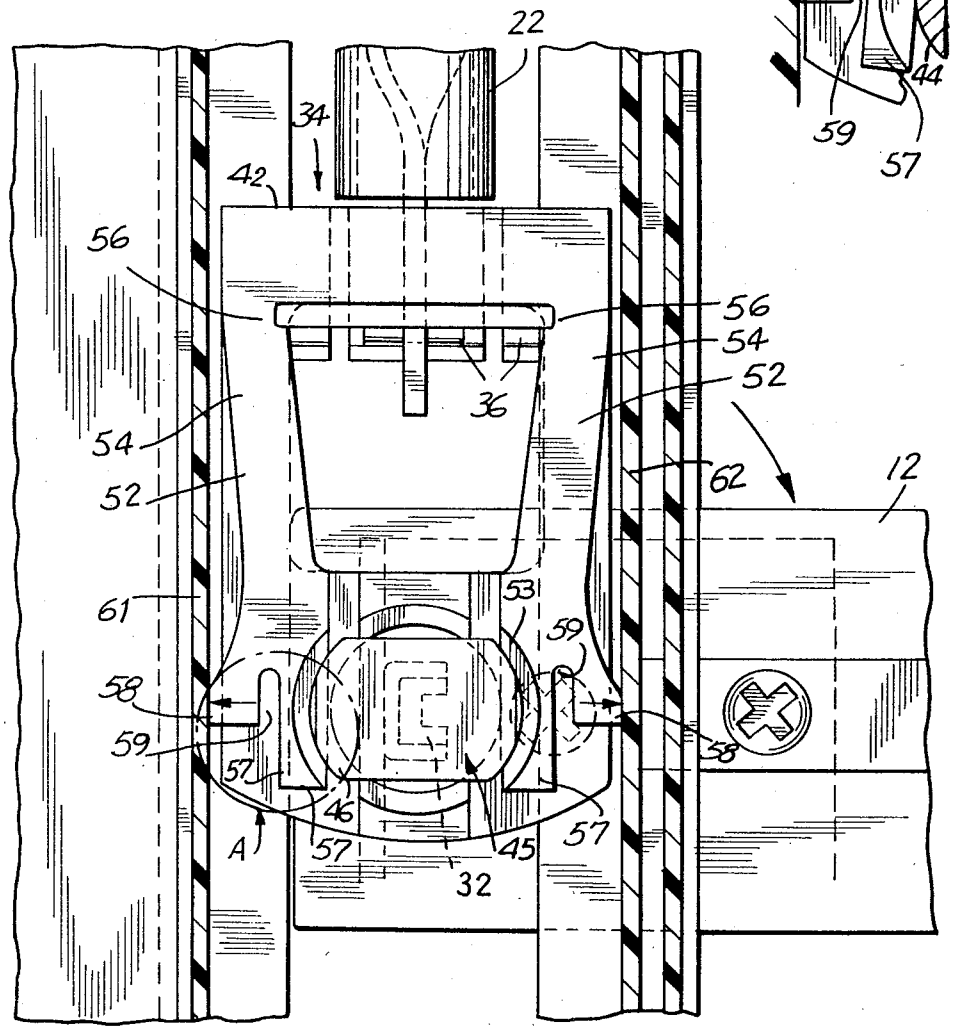
FIG. 7 is a cross-sectional view similar to FIG, 5 but taken on line 7—7 of FIG. 4.

FIG. 7 is in many respects similar to FIG. 5, except that it shows the bearing element 45 in its engaging position angularly displaced through 90° relative to the releasing position. This engaging position was achieved by turning the respective sash 12 about the axis of the opening 39, with the support element 32 turning jointly with the sash 12 and entraining the bearing element 44 for joint movement therewith. Hence, the flats 50 disengage the holding regions 57 and the circumferentially adjacent cylindrical regions od the shank portion 44 engage the holding regions 57 instead, with attendant spreading of the arms 52 until the detaining portions 58 engage the side portions 61 and 62 and frictionally detain the mounting device 21 in its then assumed vertical position.

Figure 8:
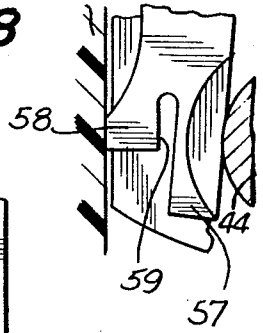
FIG. 8 is a further cross-sectioned view of a detail A of FIG. 7.

In FIG. 7, the arms 52 are shown in their engaging position within a relatively wide channel 59 or 60, that is, with the slots 59 virtually intact. On the other hand, FIG. 8 illustrates the same engaging position, but within a relatively narrow channel 59 or 60. In this instance, the detaining portion 58 is pivoted out of its original position, and the slot 59 is narrowed.

It will be understood that each of the elements described above, or two or more together may also find a useful application in other types of arrangements differing from the type described above.

While the invention has been illustrated and described as embodied in arrangement for tiltably mounting a window sash, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. An arrangement for mounting a lateral region of a window sash in a track of a lateral portion of a sash window frame for sliding longitudinally of the track in a normal position of the window sash in which the latter extends along the plane of the sash window frame, and for tilting into a plurality of tilted positions in which the window sash includes different angles with the plane of the sash window frame, comprising a mounting slide received in the track for sliding longitudinally thereof and including a main portion having two lateral portions each having a sliding surface facing oppositely with respect to the respectively other sliding surface and away from the latter and toward a respective side portion of the track for slidingly guiding said main portion in the track, and top and bottom portions, means for bounding a cylindrical through opening through said main portion, and two arms depending from said top portion in juxtaposition with said main portion to and beyond said opening, said arms having respective holding regions which bound a passage therebetween which is axially aligned with said opening and detaining portions which face the side portions of the track, said arms being resilently yieldable substantially in opposite directions along the bottom portion of said main portion toward and away from the respective side portions of the track while being integral with said top portion of said mounting slide;

a bearing element having a substantially cylindrical shank portion and a disc-shaped end flange portion delimiting said shank portion, said shank portion having a mounting region which, in an assembled condition of said bearing element with said mounting slide, is received in said opening of said main portion of the latter, and a spreading region situated intermediate said mounting region and said end flange portion and passing through said passage in said assembled condition, said spreading region having at least two diametrically opposite first surfaces spaced a smaller first distance from one another, and at least two diametrically opposite second surfaces spaced a greater second distance from one another and situated circumferentially between said first surfaces, said first and second surfaces facing said holding regions of said arms respectively in a first and a second position of said bearing element to determine the spacing of said arms from one another; and means for mounting said bearing element on the lateral region of the window sash for joint tilting movement therewith with the normal position corresponding to said first position with said detaining portions of said arms being spaced from the side portions of the track for permitting unimpeded movement of the mounting slide longitudinally of the track, and with the tilted position corresponding the said second postion with said second surfaces pressing said detaining portions against the side portions of the track for detaining said mounting slide in its then assumed position in the track so long as the sash window is in its tilted position.

2. The mounting arrangement as defined in claim 1, wherein said mounting means for said bearing element includes an elongated support element connected to the lateral region of the window sash and having a non-circular cross section, said support element extending into said bearing element and being connected thereto for said joint movement.

3. The mounting arrangement as defined in claim 2, wherein said support element has a substantially U-shaped cross section.

4. The mounting arrangement as defined in claim 3, wherein said bearing element has a recess extending at least over a part of the axial dimension of said bearing element and having a U-shaped cross section substantially conforming to that of said support element for receiving a free end portion of the latter.

5. The mounting arrangement as defined in claim 1, wherein each of said arms has a slot separating said detaining portion from said holding region for permitting limited elastic displacement of the former with respect to the latter.

6. The mounting arrangement as defined in claim 1, wherein said mounting region of said shank portion of said bearing element has a circumferentially extending groove therein, and wherein said main portion of said mounting slide has at least one bulge in said opening which is received in said groove.

7. The arrangement as defined in claim 1, wherein said first surfaces are respective flats in said spreading region, and said second surfaces are partially cylindrical surfaces extending between the flats.

8. The arrangement as defined in claim 1, wherein said mounting region is substantially cylindrical; wherein said second surfaces are substantial extensions of the outline of said mounting region onto said spreading region while said first surfaces are inwardly recessed therefrom; and wherein said holding regions extend into close proximity of said first surfaces in said first position of said bearing element to engage behind said mounting region.

9. The arrangement as defined in claim 1, wherein said holding regions of said arms have a recess therein for substantially fully receiving said flange portion and for permitting the same to turn in said recess during the turning motion of said bearing element relative to said mounting slide.

* * * * *